US008447193B2

(12) United States Patent
Mizuno

(10) Patent No.: US 8,447,193 B2
(45) Date of Patent: May 21, 2013

(54) PRINTING APPARATUS, PRINTING METHOD, AND COMPUTER-READABLE STORAGE MEDIUM FOR IMPLEMENTING THE PRINTING METHOD

(75) Inventor: Yoshitake Mizuno, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 251 days.

(21) Appl. No.: 12/975,303

(22) Filed: Dec. 21, 2010

(65) Prior Publication Data

US 2011/0158673 A1 Jun. 30, 2011

(30) Foreign Application Priority Data

Dec. 28, 2009 (JP) ..... 2009-297379

(51) Int. Cl.
*G03G 15/00* (2006.01)

(52) U.S. Cl.
USPC ..... 399/16; 399/75

(58) Field of Classification Search
USPC ..... 399/16, 75
See application file for complete search history.

(56) References Cited

U.S. PATENT DOCUMENTS 4,783,681 A * 11/1988 Tanaka et al. ..... 399/13
5,568,246 A * 10/1996 Keller et al. ..... 399/382
7,245,838 B2 * 7/2007 Swift ..... 399/8
7,280,771 B2 * 10/2007 Mandel et al. ..... 399/9
7,639,958 B2 * 12/2009 Okamoto et al. ..... 399/38
2003/0044186 A1 * 3/2003 Kato et al. ..... 399/16
2004/0190925 A1 * 9/2004 Baruch et al. ..... 399/69
2008/0126860 A1 * 5/2008 Sampath et al. ..... 714/25

FOREIGN PATENT DOCUMENTS

JP 2007-011028 A 1/2007
JP 2008-139589 A 6/2008

OTHER PUBLICATIONS

Subject Matter Eligibility of Computer Readable Media, David J. Kappos, Official Gazette of the United States Patent and Trademark Office, 1351 OG 212 (Feb. 23, 2010).*

* cited by examiner

*Primary Examiner* — David Gray
*Assistant Examiner* — Tyler Hardman
(74) *Attorney, Agent, or Firm* — Carter, DeLuca, Farrell & Schmidt LLP

(57) ABSTRACT

A printing apparatus connected to another printing apparatus to feed sheets to the another printing apparatus includes a reception unit configured to receive, from another printing apparatus, stop detection information regarding timing of a printing stop in another printing apparatus, and a control unit configured to feed sheets for performing printing up to a page indicated by the stop detection information received by the reception unit, perform printing on the sheets to prevent retention of the fed sheets, and cancel feeding preparation of the sheets for printing the page indicated by the stop information and succeeding pages.

13 Claims, 14 Drawing Sheets

FIG.10

| | | | |
|---|---|---|---|
| 1001 | ADJUSTMENT CONTENT | CONSTANT-SPEED AUTOMATIC GRADATION CORRECTION | 1002 |
| 1003 | AFTER A NUMBER OF PAGES (Page ID) | 12 (pgid: 0x1d9a) | 1004 |
| 1005 | ADJUSTMENT PERIOD OF TIME | 62030 ms | 1006 |

PRINTING APPARATUS, PRINTING METHOD, AND COMPUTER-READABLE STORAGE MEDIUM FOR IMPLEMENTING THE PRINTING METHOD

BACKGROUND OF THE INVENTION

1. Field of the Invention

The present invention relates to a printing apparatus that forms, by using a plurality of printing apparatuses, an image on a sheet of paper by first toner and second toner, a printing method, and a computer-readable storage medium for implementing the printing method.

2. Description of the Related Art

Recently, there has been offered an electrophotographic apparatus that uses clear toner as a special recording material. The clear toner is a transparent recording material for adding a transmissive image.

The use of the clear toner enables various expressions, adding more values to output products. A mechanism of adding the clear toner in addition to color toner such as cyan, magenta, yellow or black (C, M, Y, or K) is incorporated in one electrophotographic apparatus, that can create an output product using the clear toner. In such an apparatus, however, when a special recording material such as a clear toner is used to perform printing, compared with conventional printing using four-color toner, a total amount of toner used for the printing is much greater.

Especially when applied to electrophotographic color printing, a special recording-material image is formed on an intermediate transfer member in addition to conventional four-color images of C, M, Y, and K, and must be transferred to a sheet.

In each electrophotographic process, an amount of applied toner that is an amount of toner necessary for printing increases. A result is a greater load on each process.

Japanese Patent Application Laid-Open No. 2007-011028 discusses a method for calculating a recordable amount of an applied special recording material from an applied four-color toner amount of C, M, Y, and K.

However, when an amount of an applied special recording material is calculated by the method discussed in Japanese Patent Application Laid-Open No. 2007-011028, the amount of an applied special recording material may be zero. For example, a total amount of applied four-color toner exceeds a total amount of application which can be fixed well on the sheet and is permitted by the printing apparatus.

In such a case, even when a user instructs printing that uses the special recording material, the printing using the special recording material based on the user' s instruction cannot be performed. Thus, no visual effect by the special recording material can be obtained.

To deal with this problem, as discussed in Japanese Patent Application Laid-Open No. 2008-139589, when it is determined that the printing using the special recording material based on the user's instruction cannot be completed by fixing an image once, a method for preparing the special recording material is changed.

More specifically, an image is first printed and fixed by using toner other than the special recording material to output a sheet. The image is then printed and fixed again, by using the special recording material, on the sheet where the image has been printed by using the toner. This printing based on the twice fixing of the image is referred to as two-pass printing.

The use of the two-pass printing enables printing that uses an amount of a special recording material equal to or greater than an amount of a special recording material determined in view of a total amount of application permitted by the printing apparatus. Thus, an output product having a visual effect provided by the special recording material as desired by the user can be obtained.

The incorporation of the mechanism corresponding to the clear toner solves a problem such as a limit on the amount of toner. However, for those who use no clear toner, the mechanism dedicated to clear toner is wasteful in terms of costs or functions.

Thus, a system is configured, which separately includes a printing apparatus using color toner and a printing apparatus using the special recording material, and connects a sheet discharge unit of the printing apparatus using the color toner to a sheet feeding unit of the printing apparatus using the special recording material, thereby generating an output product using the special recording material in a collective manner. For example, for the user who performs printing using the special recording material, the system that interconnects the printing apparatus using the color toner and the printing apparatus using the special recording material is provided. For the user who uses no special recording material, only the printing apparatus using the color toner is provided. Creating such a mechanism of interconnecting two printing apparatuses enables configuration of a system in response to a user's request. However, in the structure where the two printing apparatuses are interconnected to be used, both printing operations stop each time one of the printing apparatuses on a front side and a rear side stalls. As a result, for example, when the printing apparatuses alternately stall, good device performance cannot be achieved as overall performance of the printing system.

SUMMARY OF THE INVENTION

According to an aspect of the present invention, a printing apparatus connected to another printing apparatus to feed sheets to another printing apparatus includes a reception unit configured to receive, from another printing apparatus, stop detection information regarding timing of a printing stop in another printing apparatus, and a control unit configured to feed sheets for performing printing up to a page indicated by the stop detection information received by the reception unit, perform printing on the sheets to prevent retention of the fed sheets, and cancel feeding preparation of the sheets for printing the page indicated by the stop information and succeeding pages.

According to another aspect of the present invention, a printing apparatus connected to another printing apparatus, to which sheets are conveyed from another printing apparatus, includes a stop detection unit configured to determine whether to execute processing regarding a printing stop, that is, whether automatic image quality adjustment is performed, whether cleaning is performed, or whether image data generation is delayed, a stop detection information generation unit configured to detect, when the stop detection unit determines that the processing regarding the printing stop is executed, timing of the printing stop, and generate information regarding the stop timing, and a transmission unit configured to transmit the stop detection information generated by the stop detection information generation unit to another printing apparatus.

When a plurality of printing apparatuses are interconnected to perform printing on the same sheet, by limiting a stopping period of time of both printing operations to a minimum each time one of the printing apparatuses on the front side and the rear side stalls, overall performance of the printing system can be improved.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 10 illustrates an example of stop detection information.

DESCRIPTION OF THE EMBODIMENTS

Various exemplary embodiments, features, and aspects of the invention will be described in detail below with reference to the drawings.

In the exemplary embodiments, clear toner is used as a special recording medium. However, recording materials are not limited to the clear toner. For example, in addition to the clear toner, other transparent recording materials such as light color toner, special color toner such as red or green, and transparent ink can be used.

The clear toner is a transparent recording material that has a characteristic of adding a transmissive image. An area where printing is performed by using the clear toner is difficult to see. When the clear toner is used, glossiness or luster different from printing performed by using only color toner can be expressed.

A printing apparatus is described by taking a MFP as an example where a plurality of functions such as a copying machine, a printer, and a facsimile is realized by one apparatus. However, exemplary embodiments are not limited to these apparatuses. Any apparatus capable of printing and outputting image data can be employed.

First, a configuration is described where a sheet discharge unit of a first MFP for performing printing by using color toner is connected to a sheet feeding unit of a second MFP for performing printing by using clear toner.

Figure 1:
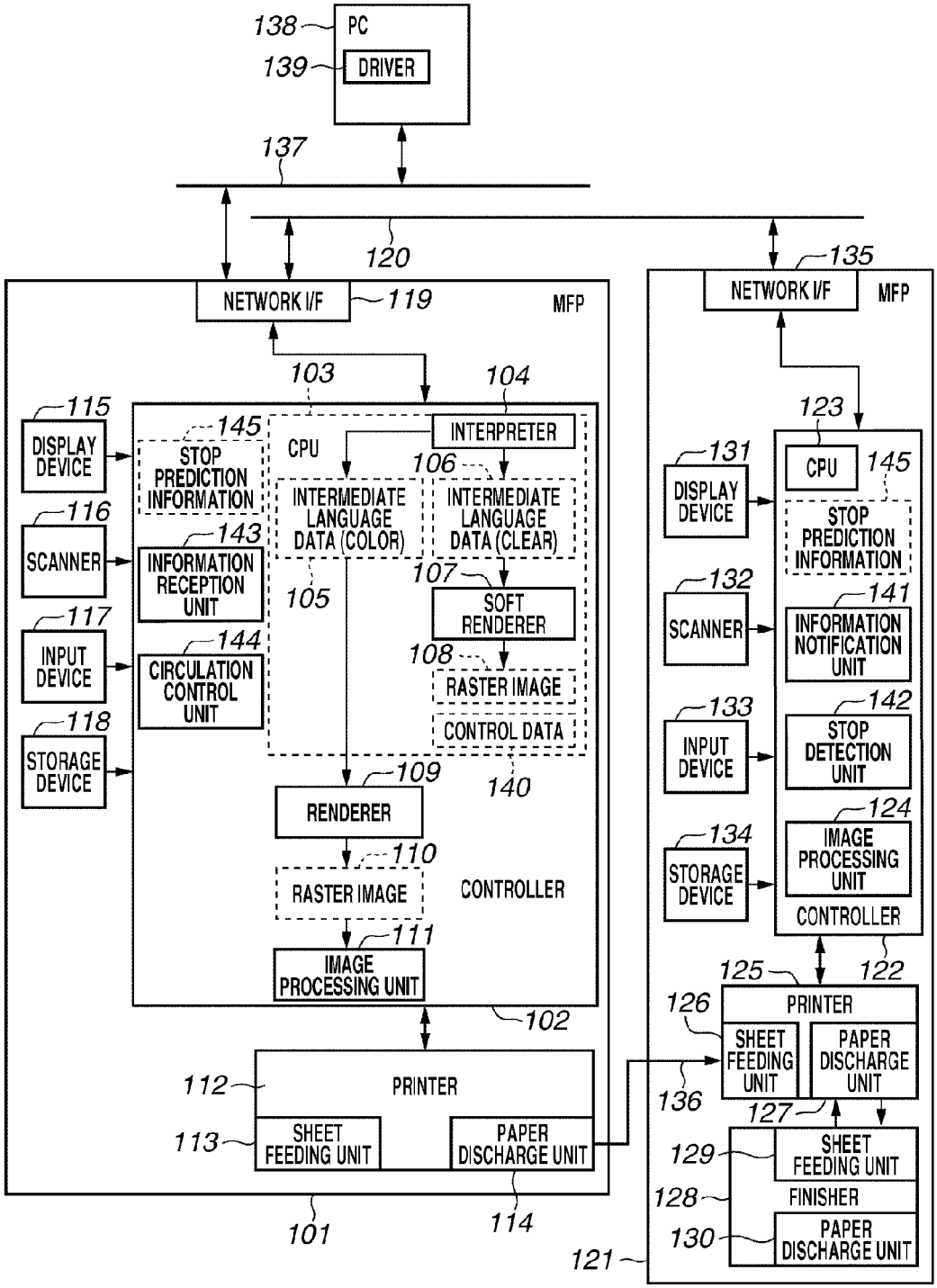
FIG. 1 illustrates a configuration of a system.

FIG. 1 illustrates a configuration of a system according to a first exemplary embodiment. A MFP 101 that is a first printing apparatus is connected to a MFP 121 that is a second printing apparatus via a network 120. The first MFP 101 uses a first color material, and accordingly performs printing by using color toner. The color material used by the first MFP 101 is not limited to the color toner. Monochrome toner can be used. Similarly, the second MFP 121 uses a second color material, and performs printing by using clear toner as a special recording material. The color material used by the second MFP 121 is not limited to the clear toner. Other special color toner can be used.

A sheet discharge unit 114 of the first MFP 101 is connected to a sheet feeding unit 126 of the second MFP 121 via a connection unit 136. Thus, a sheet discharged from the first MFP 101 can be automatically fed to the second MFP 121.

When the first MFP 101 finishes printing of sheets and the sheets are sequentially loaded on the connection unit 136, in order to feed the plurality of sheets loaded on the connection unit 136, the second MFP 121 must pull out the bottom one of the loaded sheets. In this case, feeding may fail and jamming may occur, or a printing order may not be aligned.

Thus, sheet discharge timing and sheet feeding timing are controlled as follows at the connection unit 136. A printer 112 of the first MFP 101 finishes printing. One sheet on which an image has been printed by color toner is discharged to the sheet discharge unit 114 to be directly conveyed to the connection unit 136. Then, before a new sheet on which an image has been printed after the end of printing by the printer 112 of the first MFP 101 is discharged to the sheet discharge unit 114, the second MFP 121 feeds the sheet loaded on the connection unit 136. This prevents loading of a plurality of sheets on the connection unit 136. The sheets are accordingly conveyed from the first MFP 101 to the second MFP 121.

A personal computer (PC) 138 is connected to the first MFP 101 via a network 137. A driver 139 in the PC 138 recognizes that the first MFP 101 and the second MFP 121 constitute one printing system using color toner and clear toner, and transmits print data. The print data contains data necessary for generating intermediate language data described below, and data as to what post-processing (finishing) is performed for a print product after printing of the intermediate language data.

In the system illustrated in FIG. 1, printing using the color toner and printing using the clear toner can be executed by one instruction.

A clear toner image printed by the second MFP 121 can be printed on the entire sheet surface. Special color data is designated during printing or copying, and an image can be printed only on the designated portion by the clear toner, or an image can be partially printed only on a specific object by the clear toner.

The first MFP 101 that uses the color toner is described in detail. A network interface (network I/F) 119 receives print data or transmits a raster image or control data described below. A controller 102 includes a central processing unit (CPU) 103, a renderer 109, and an image processing unit 111. The CPU 103 controls software processing of an interpreter 104 and a soft renderer 107. The interpreter 104 of the CPU 103 interprets a page-description language (PDL) portion of the received print data to generate intermediate language data (color) 105. The renderer 109 generates raster image (color) 110 from the generated intermediate language data (color) 105. The image processing unit 111 processes the raster image (color) 110 or an image read by a scanner 116. The printer 112 connected to the controller 102 forms an image on a sheet fed by using color toner such as cyan, magenta, yellow, or black according to output data. The printer 112 includes a sheet feeding unit 113 that feeds sheets used for printing, and a sheet discharge unit 114 that discharges sheets on which output data have been generated. A display device 115 displays a user interface (UI) indicating an instruction to a user or a state of the first MFP 101. The scanner 116 includes an auto document feeder. The scanner 116 irradiates a plurality or one original image with light from a light source (not illustrated), forms an original reflected image on a solid-state image sensor such as a charge-coupled device (CCD) sensor by a lens, and acquires a raster image reading signal as image data from the solid-state image sensor. An input device 117 is an interface for receiving an input from the user. A storage device 118 stores data processed by the controller 102.

When the print data contains an instruction of printing an image by using clear toner, the interpreter 104 generates intermediate language data (clear) 106 in addition to the intermediate language data (color) 105. As an example of a data format of this intermediate language data, a "profile with a name" to instruct printing using the clear toner for a certain designated portion is used. Processing that uses this data format is described. When a specific character string is set corresponding to a certain input color by using an application, a profile with a name corresponding to the character string is selected. Thus, when the driver 139 of the PC 139 sets a specific character string corresponding to the clear toner, a corresponding profile with a name is selected, and clear toner selection instruction for a portion targeted for printing using the clear toner can be issued. The interpreter 104 generates the intermediate language data (clear) 106 by extracting only a clear-toner designated portion to form a layer. The soft renderer 107 converts the intermediate language data (clear) 106 into a raster image (clear) 108. The first MFP 101 transmits the raster image (clear) 108 thus generated to the second MFP 121 via the network 120. As the method for instructing printing for the portion targeted for printing by the clear toner, the profile with the name has been described. However, any method can be used as long as it can generate a raster image (clear) 108 for instructing printing using the clear toner. The first MFP 101 transmits control data 140 to the second MFP 121 via the network 120. The control data 140 is information on the number of sheets, a sheet size, a medium type, or finisher setting made by the user via the driver 139.

Next, the second MFP 121 that uses the clear toner is described in detail. A network I/F 135 is connected to the network I/F 119 via the network 120, and data is transmitted/received between the first MFP 101 and the second MFP 121. A controller 122 includes a CPU 123 and an image processing unit 124. A printer 125 connected to the controller 122 prints an image on a sheet by using the clear toner. The printer 125 includes a sheet feeding unit 126 that feeds sheets, and a sheet discharge unit 127 that discharges sheets on which output data have been generated. The sheet feeding unit 126 is connected to the sheet discharge unit 114 of the first MFP 101 via the connection unit 136 to automatically feed sheets fed from the first MFP 101. This sheet feeding method has been described above. A finisher 128 has sorting and stapling functions. The sheet discharge unit 127 of the printer 125 and a sheet feeding unit 129 of the finisher 128 are interconnected. Processing such as sorting or stapling designated by the user is performed, and a result is then output by using the sheet discharge unit 130. A display device 131, a scanner 132, an input device 133, and a storage device 134 are similar to those included in the first MFP 101, and thus description thereof is omitted.

The second MFP 121 receives the raster image (clear) 108 and the control data 140 associated with the raster image (color) 110 generated from the intermediate language data (color) 105 from the first MFP 101. Thus, the color image and the clear image printed on the same sheet can be tied. The image processing unit 124 processes the raster image (clear) 108, and the printer 125 and the finisher 128 are controlled based on the control data 140.

In the flow of the data, the raster data (clear) is transmitted from the controller of the first MFP 101 to the controller of the second MFP 121. This is because the intermediate language data has been rendered in the first MFP 101. However, when the controller of the second MFP 121 includes a clearing renderer, the intermediate language data (clear) can be transmitted from the first MFP 101 to the second MFP 121, and the second MFP 121 can generate raster data (clear). In this case, the intermediate language data (clear) is not rendered in the first MFP 101.

Thus, when the color data and the clear data are both rendered in the first MFP 101, first print data is set as raster data (color), and second print data is set as raster data (clear).

When the clear data is rendered in the second MFP 121, the first print data is set as intermediate language data (color), and the second print data is set as intermediate language data (clear). In the description below, to render the clear data in the first MFP 101, the first print data is set as raster data (color), and the second print data is set as raster data (clear).

A stop detection unit 142 detects a stop of a sheet feeding operation of the apparatus caused by failure of printing in the second MFP 121 for one reason or another. The reason may be that an automatic tone correction function for correcting a gradation based on a density measured by forming an image on an intermediate transfer belt or PDL rendering is not ready, or an image to be printed may not be ready due to resource competition, or cleaning or other adjustments. Stop detection information 145 generated by the stop detection unit 142 is notified to the first MFP 101 by the information notification unit 141, and information reception unit 143 receives the stop detection information 145. The information reception unit 143 that receives the information notifies a circulation control unit 144 of the information. Based on the received information, the circulation control unit 144 switches own-machine sheet circulation control. In this case, the first MFP 101 can include the stop detection unit 142 and the information notification unit 141. The second MFP 121 can include the information reception unit 143 and the circulation control unit 144.

Figure 2:
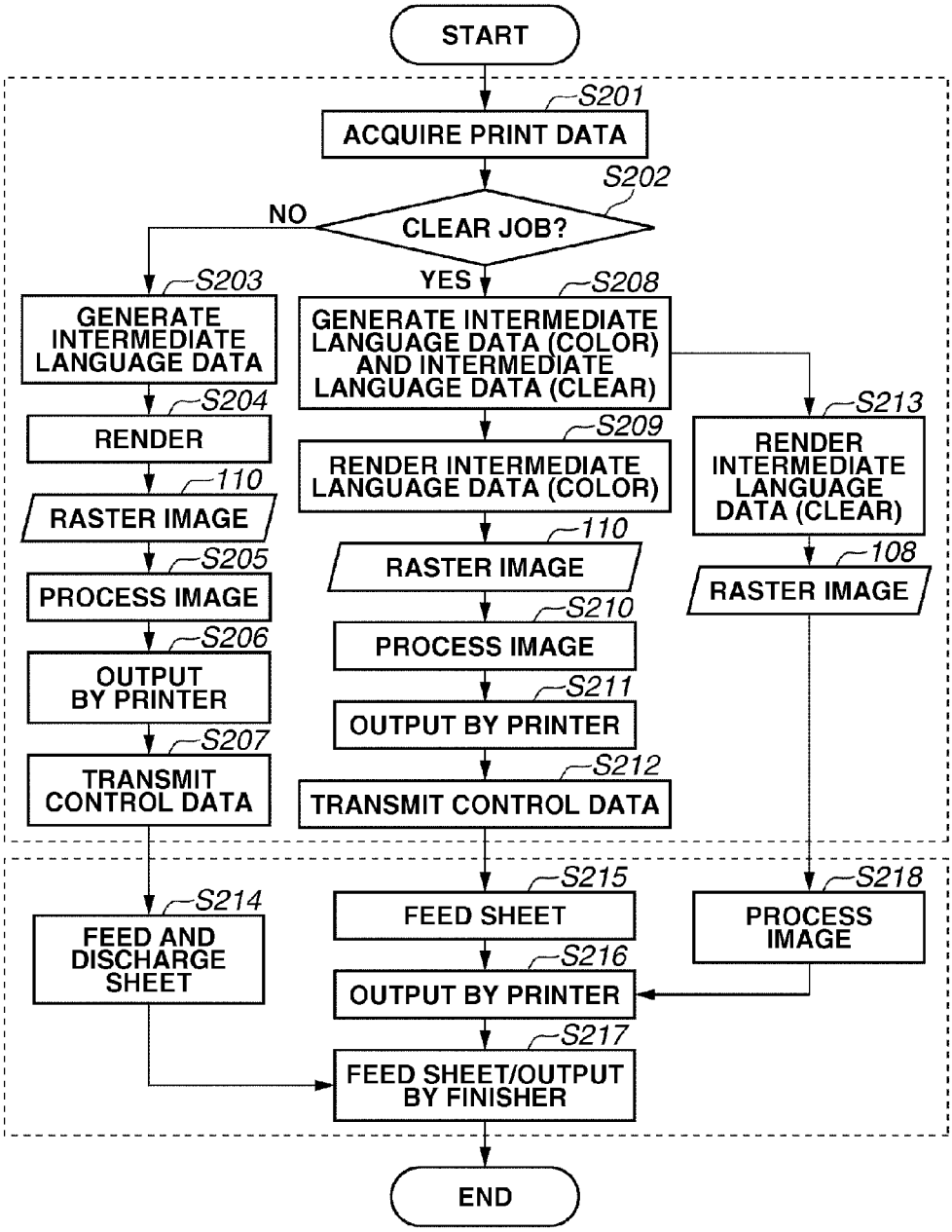
FIG. 2 is a flowchart illustrating a flow of printing.

Next, referring to FIG. 2, a flow of printing executed by the PC 138 using the driver 139 in the system of the present exemplary embodiment is described.

A program concerning processing from step S201 to step S213 is stored in the storage device 118 of the first MFP 101, and called in to a random access memory (RAM not illustrated) to be executed by the CPU 103. A program concerning processing from step S214 to step S218 is stored in the storage device 134 of the second MFP 121, and called in to a RAM (not illustrated) to be executed by the CPU 123.

In step S201, the controller 102 acquires print data transmitted from the PC 138. As described above, for example, when transmitting print data, the PC 138 can make a clear instruction for a specific color or object by associating a portion of the print data desired for clear printing with a profile with a name. In step S202, the CPU 103 refers to the profile with a name in the print data to determine whether an instruction is given to print the data with clear toner (hereinafter, clear job). When the data is not a clear job (No in step S202), in step S203, the interpreter 104 generates intermediate language data (color) 105. In step S204, the renderer 109 performs rendering to generate a raster image (color) 110. In step S205, the image processing unit 111 performs image processing. In step S206, the printer 112 outputs data obtained by processing a raster image (color) by using color toner of CMYK, to a sheet. In step S207, the CPU 103 transmits control data 140 to the controller 122 of the second MFP 121 via the network I/F 119. In step S214, the second MFP 121 feeds or discharges sheets based on the control data 140. The print data is determined not to be the clear job (NO in step S202), and thus no clear toner is used. In step S217, the finisher 128 feeds and outputs sheets based on the control data 140. When processing such as sorting is designated in the control data 140, the finisher 128 performs processing according to the instruction.

On the other hand, when the print data is determined to contain the clear job including the printing instruction using the clear toner (YES in step S202), the processing proceeds to step S208. In step S208, the interpreter 104 generates intermediate language data (color) 105 and intermediate language data (clear) 106. In step S209, the renderer 109 renders the intermediate language data (color) 105 to generate a raster image (color) 110 that is first print data. In step S210, the image processing unit 111 performs image processing. In step S211, the printer 112 prints data obtained by processing the raster image (color) using color toner of CMYK on a sheet. In step S212, the CPU 103 transmits the control data 140 to the controller 122 of the second MFP 121 via the network I/F 119. In step S213, the soft renderer 107 renders the intermediate language data (clear) 106 to generate a raster image (clear) 108 that is second print data, and transmits the raster image 108 to the second MFP 121. In step S215, the second MFP 121 feeds, referring to the control data 140, a sheet where color toner has been printed and which has been discharged via the connection unit 136. In step S218, the image processing unit 124 processes the raster image (clear) 108. The image processing in this case is processing necessary for converting the raster image (clear) 108 into data matching characteristics of an engine for printing the clear toner. For example, a screening process is included.

In step S216, the printer 125 prints the raster image (clear) on the fed sheet by using the clear toner. In step S217, based on the control data 140, the finisher 128 performs sheet feeding and printing. As described above, by using the first MFP 101 and the second MFP 121, the image printed by the color toner of CMYK by the instruction made once from the driver 139 and the image printed by the clear toner can be printed on one and the same sheet.

When the data is transmitted to the second MFP 121 at the stage of the intermediate language data (clear), step S213 is executed by the controller 122 of the second MFP 121.

Figure 3:
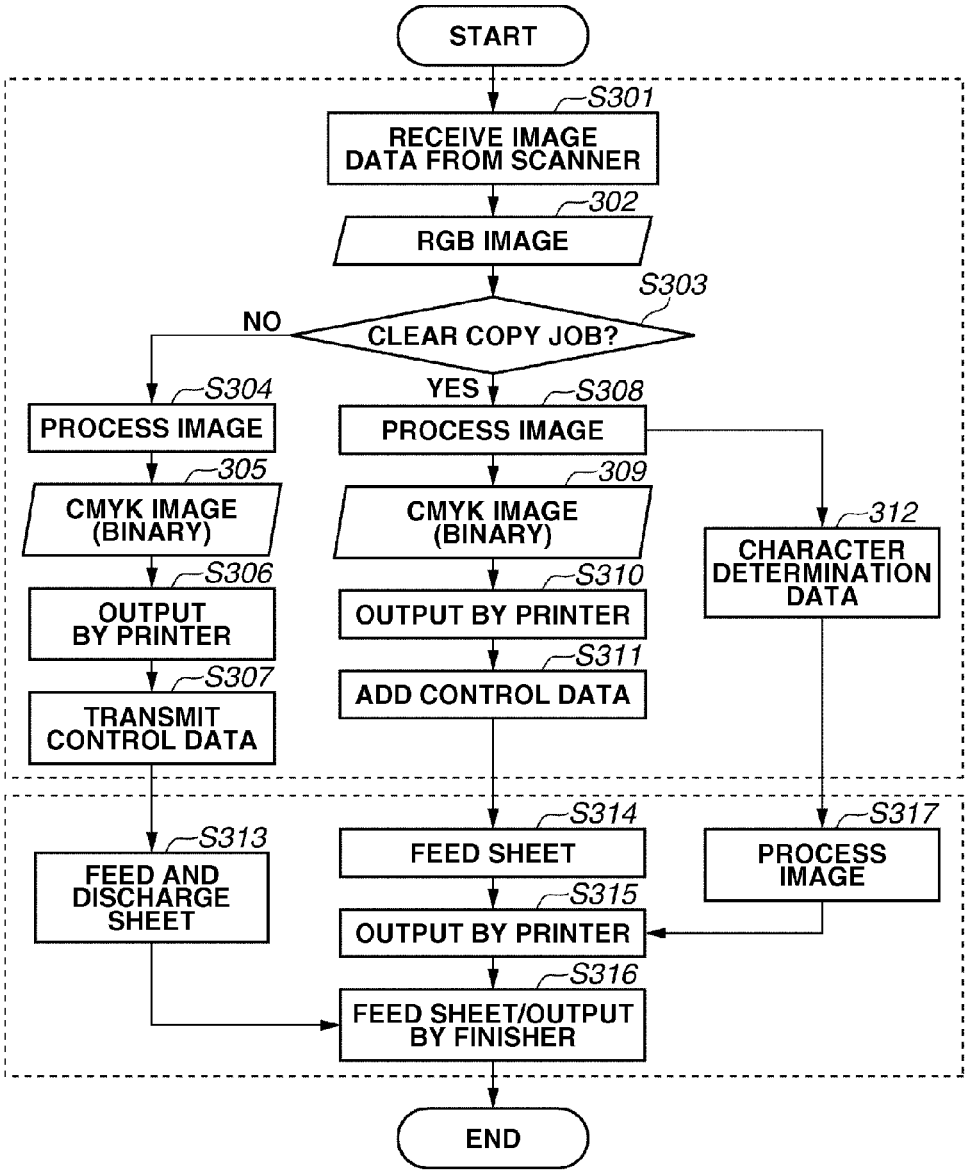
FIG. 3 is a flowchart illustrating a flow of copying.

FIG. 2 illustrates the flow of printing performed in the system according to the present exemplary embodiment. FIG. 3 illustrates a flow of copying performed in the system according to the present exemplary embodiment. A program concerning step S301 to step S312 is stored in the storage device 118 of the first MFP 101, and called in to the RAM (not illustrated) to be executed by the CPU 103. A program concerning step S313 to S317 is stored in the storage device 134 of the second MFP 121, and called in to the RAM (not illustrated) to be executed by the CPU 123. In step S301, the controller 102 receives an image acquired by the scanner 116 to acquire a RGB image 302.

Then, for example, the display device 115 of the first MFP 101 displays a copy button for instructing whether to print clear toner on a specific object in the image. In step S303, whether the data is a clear job for adding clear toner to a copying target image instructed to be copied by the user is determined. When the data is determined not to be a copy job to add any clear toner (NO in step S303), in step S304, the image processing unit 111 performs image processing to print a CMYK image (binary) 305.

On the other hand, when the data is determined to be a clear copy job (YES in step S303), in step S308, the image processing unit 111 performs image processing to print a CMYK image (binary) 309. In step S308, data regarding an area where printing by the clear toner is instructed during the image processing is generated.

For example, it is assumed that printing by clear toner is instructed only for a specific object present on an original that becomes a copying target as described above. When the specific object is a text, a character portion in the original is determined to acquire character determination data 312. The character portion can be determined by a well-known technology, and thus description thereof is omitted. The use of the determination data of the character portion enables addition of clear toner only to the character portion in the original. In the present exemplary embodiment, the character determination data is used as an example of data for adding the clear toner to the specific object. However, the clear toner can be added to an object by other methods. For example, only a specific hue object is extracted to add the clear toner.

The character determination data 312 is transmitted as raster image data for the clear toner to the second MFP 121. Steps S306 and S307 are similar to steps S206 and S207, and thus description thereof is omitted. Steps S310 and S311 are similar to steps S211 and S212, and thus description thereof is omitted. Steps S313 to S317 are similar to steps S214 to S218, and thus description thereof is omitted.

Figure 4:
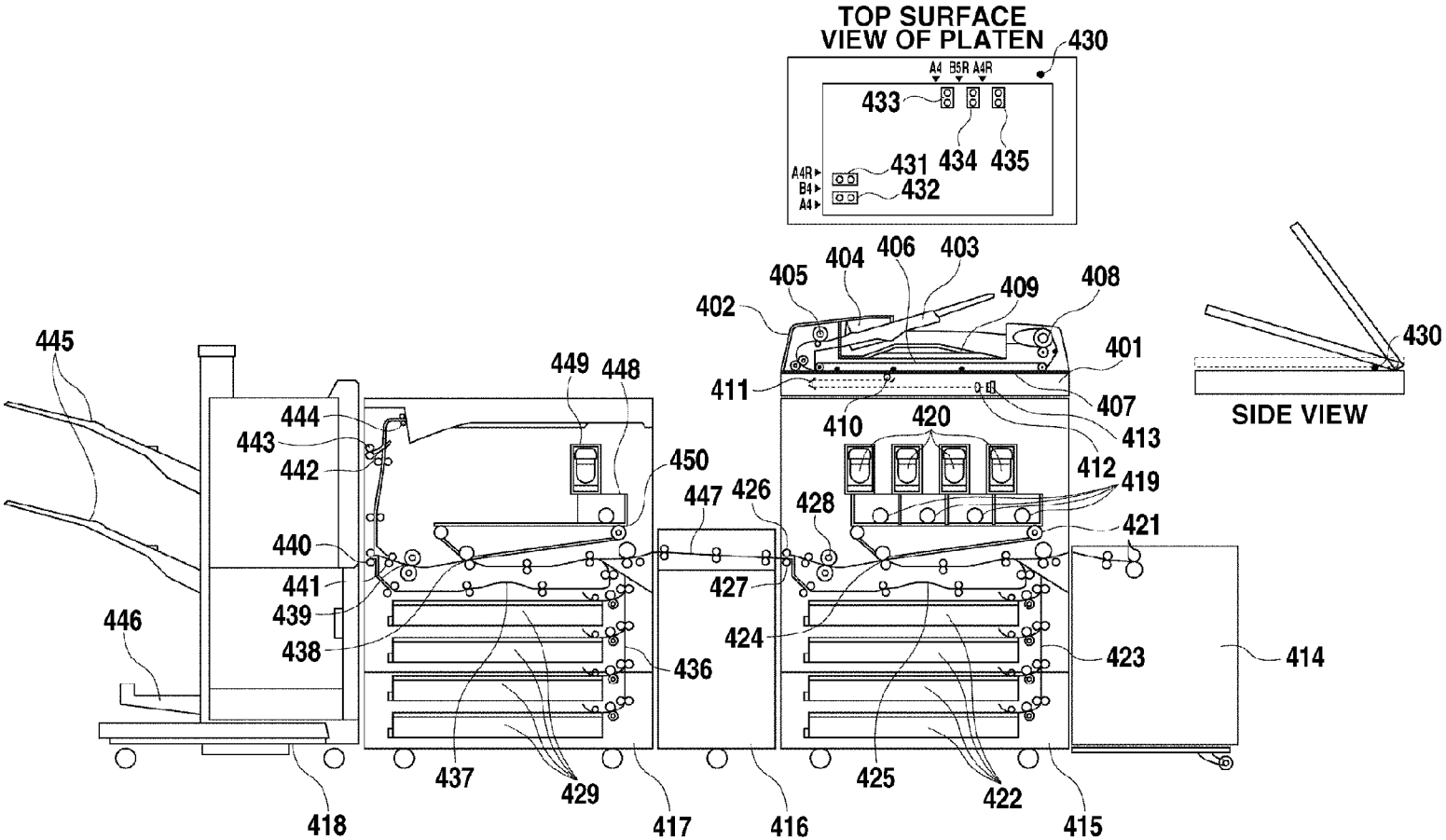
FIG. 4 illustrates the configuration of the system more in detail.

Next, referring to FIG. 4, the configuration of the printing system illustrated in FIG. 1 is described in detail. As an example, a configuration where a sheet discharge unit of a first MFP 415 for performing printing by using color toner and a sheet feeding unit of a second MFP 417 for performing printing by using clear toner are interconnected via a connection unit is described.

The first MFP 415 includes functions of a copying machine, a printer, and a facsimile. In FIG. 4, the first MFP 415 includes a scanner 401, a document feeder (DF) 402, print engines (419 and 420) for print-recording, which include four color drums, and a sheet feeding deck 414.

First, a reading operation mainly performed by the scanner 401 is described. When an original is set on a platen to be read, the original is set on the platen 407 and the DF 402 is closed. An opening/closing sensor 430 detects closing of the platen, and then reflective original size detection sensors 431 to 435 included in a casing of the scanner 401 detect a size of the set original. Starting from this size detection, the original is irradiated with light from a light source 410. An image sensor 413 reads an image via a reflective plate 411 and a lens 412. The image is then converted into a digital signal, and subjected to desired image processing to be converted into a laser recording signal. The converted recording signal is stored in a memory in a controller of the first MFP 415 (equivalent to the storage device 118 in the controller 102 of the first MFP 101 illustrated in FIG. 1).

When the original is set on the DF 402 to be read, the original is set face-up on a tray of an original setting unit 403 of the DF 402. An original presence detection sensor 404 detects setting of the original. An original feed roller 405 and a conveyor belt 406 accordingly rotate to convey the original, and the original is set in a predetermined position on the platen 407. Thereafter, an image is read as in the case of reading on the platen, and stored in the memory in the controller. After completion of the reading, the conveyor belt 406 rotates again to feed the original to the right illustrated in FIG.

4. The original is discharged via a conveyor roller 408 of a discharge side to an original discharge tray 409. When there is a plurality of originals, simultaneously with feeding of an original from the platen to the right illustrated in FIG. 4, a next original is fed from the left via the feed roller 405, and the next original is continuously read. This is the operation of a scanner.

A printing operation performed mainly by the printer is described. A recording signal (print image data) stored in the memory in the controller is transferred to the printer (printer 112 illustrated in FIG. 1), and converted into a four-color recording laser beam of yellow, magenta, cyan, and black by a laser recording unit. The laser beam is applied to the photosensitive drum 419 of each color to form an electrostatic latent image on the photosensitive drum. The electrostatic latent image is developed by toner supplied from a toner cartridge 420. The visualized image is primary-transferred to the intermediate transfer belt 421. An intermediate transfer belt 421 then rotates clockwise, and a recording sheet fed from a sheet cassette 422 or the sheet feeding deck 414 through a sheet feeding conveyance path 423 arrives at a secondary-transfer position 424. The image is transferred from the intermediate transfer belt 421 to the recording sheet. A fixing device 428 fixes toner, by pressure and heat, on the recording sheet onto which the image has been transferred. The recording sheet is conveyed through the sheet discharge conveyance path to be discharged to a side tray 427 set face-up.

In the case of two-sided printing, after passage through the fixing device 428, a flapper 426 switches a conveyance path. A sheet is switched back to feed a recording sheet downward. The recording sheet is fed again through a two-sided printing sheet conveyance path 425 to the primary-transfer position 424, thereby realizing a two-sided operation.

The sheet then enters, via the side tray 427, a conveyance path 447 in an intermediate buffer unit 416, and stands by until the second MFP 417 starts to feed the sheet.

In the present embodiment, the intermediate buffer permits standing-by of one sheet. However, up to two sheets can stand by.

The second MFP 417 includes print engines (448 and 449) for print recording, which include a single drum for performing clear toner printing, and a finisher 418.

A recording signal (print image data) stored in the memory in the controller 122 illustrated in FIG. 1 is transferred to the printer 125, and converted into a recording laser beam of a single clear color by the laser recording unit. The laser beam is applied to the photosensitive drum 448 of each color to form an electrostatic latent image on the drum. The electrostatic latent image is developed by toner supplied from the toner cartridge 449. The visualized image is primary-transferred onto an intermediate transfer belt 450. The intermediate transfer belt 450 then rotates clockwise, and a recording sheet is fed from a sheet cassette 429 through a sheet feeding conveyance path 436 or from the intermediate buffer conveyance path 447 to reach a secondary-transfer position 438. An image is transferred from the intermediate transfer belt 450 to the recording sheet. A fixing device 439 fixes toner, by pressure and heat, on the recording sheet onto which the image has been transferred. After conveyance through the sheet discharge conveyance path, the recording sheet is discharged to a center tray 444 set face-down, or switched back to be discharged to a sheet discharge opening 443 leading to the finisher or a side tray 440 set face-up (however, the side tray 440 is a sheet discharge opening which can discharge a sheet only when the finisher 418 is not loaded). Flappers 442 and 441 are for switching a conveyance path to switch these discharge openings. In the case of two-sided printing, after passage through the fixing device 439, the flapper 441 switches a conveyance path. The sheet is then switched back to feed the recording sheet downward, and the recording sheet is fed again through a two-sided printing sheet conveyance path 437 to the secondary-transfer position 438, thereby realizing a two-sided operation.

An operation performed by the finisher 418 is described. The finisher 418 additionally performs post-processing for a printed sheet according to a function designated by the user. Specifically, the finisher 418 has a function of stapling (one or two place stapling), punching (two holes or three holes), or bookbinding saddle stitching. The second MFP 417 includes two sheet discharge trays 445. For a recording sheet passing through the sheet discharge opening 443 to the finisher 418, based on user's setting, for example, a sheet discharge tray is allocated for each copying, printer or facsimile function. A side tray 446 is allocated for saddle folding or stapling in bookbinding. The second MFP 417 may be a printer of one clear drum. However, the second MFP 417 may be an engine of one or four color drums, or a printer engine of black and white printing. When used as a printer, the second MFP 417 can set various modes such as black and white printing/color printing, a sheet size, 2UP/4UP printing/N-UP printing, two-sided, stapling, punching, bookbinding saddle stitching, and a front cover/back cover.

Figure 5:
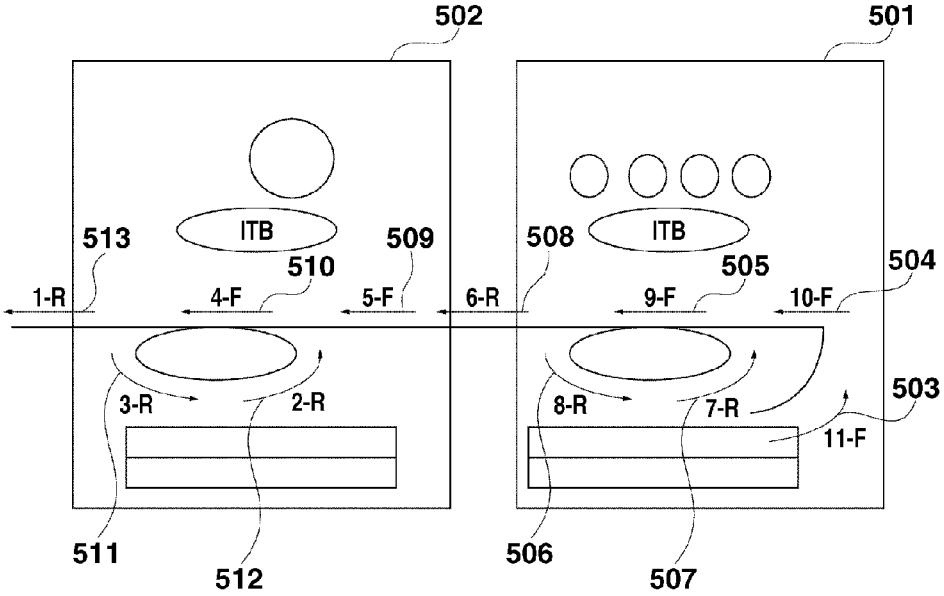
FIG. 5 illustrates a sheet conveyance path during printing.

Next, referring to FIG. 5, a sheet conveyance path when printing is performed by using the printing system according to the present exemplary embodiment is described.

As an example of two-sided printing performed in a configuration, a first MFP 501 using color toner and a second MFP 502 using clear toner are connected in series. The present exemplary embodiment can be applied not only to the two-sided printing but also to one-sided printing.

The example illustrated in FIG. 5 shows a state where totally eleven sheets 503 to 513 are retained in the apparatus. A path through which a sheet is discharged from a sheet feeding stage passes is described.

The first MFP 501 feeds a sheet from the sheet feeding stage to a position of a sheet 503. The first MFP 501 fixes a four-color image on a front surface of the sheet passing through positions of a sheet 504 and a sheet 505, and entering a two-sided path, fixes the four-color image on a rear surface passing through positions of a sheet 506, a sheet 507, and the sheet 505. The first MFP 501 then discharges the sheet to a position of a sheet 508 in an intermediate buffer.

The second MFP 502 feeds the sheet from the intermediate buffer to a position of a sheet 509. The second MFP 502 fixes a clear image on the front surface of the sheet passing through a position of a sheet 510, and entering a two-sided path, fixes the clear image on the rear surface passing through positions of a sheet 511, a sheet 512, and the sheet 510. The second MFP 502 then discharges the sheet to a position of a sheet 513 on the side tray.

A printing order in the first MFP 501 illustrated in FIG. 5 is described.

A sheet 508 is a sixth sheet, and data have been printed on two sides. A printing order in the first MFP 501 on the sheet 508 and after is firstly the printing on a front surface of the sheet 508, a front surface of the sheet 507, and a front surface of the sheet 506. Then, the first MFP 501 prints data on a rear surface of the sheet 508, a front surface of the sheet 505, a rear surface of the sheet 507, a front surface of the sheet 504, a rear surface of the sheet 506, a front surface of the sheet 503, a rear surface of the sheet 505, a rear surface of the sheet 504, and a rear surface of the sheet 503 in order.

In the state illustrated in FIG. 5, the second MFP 502 cannot load a plurality of sheets on the intermediate buffer. Unless the sheet 508 is fed to the intermediate buffer, therefore, the first MFP 501 cannot continue printing, resulting in continued retention of the sheets 503 to 507 in the same places. This bends or damages the sheets, causing uneven transfer.

Figure 6:
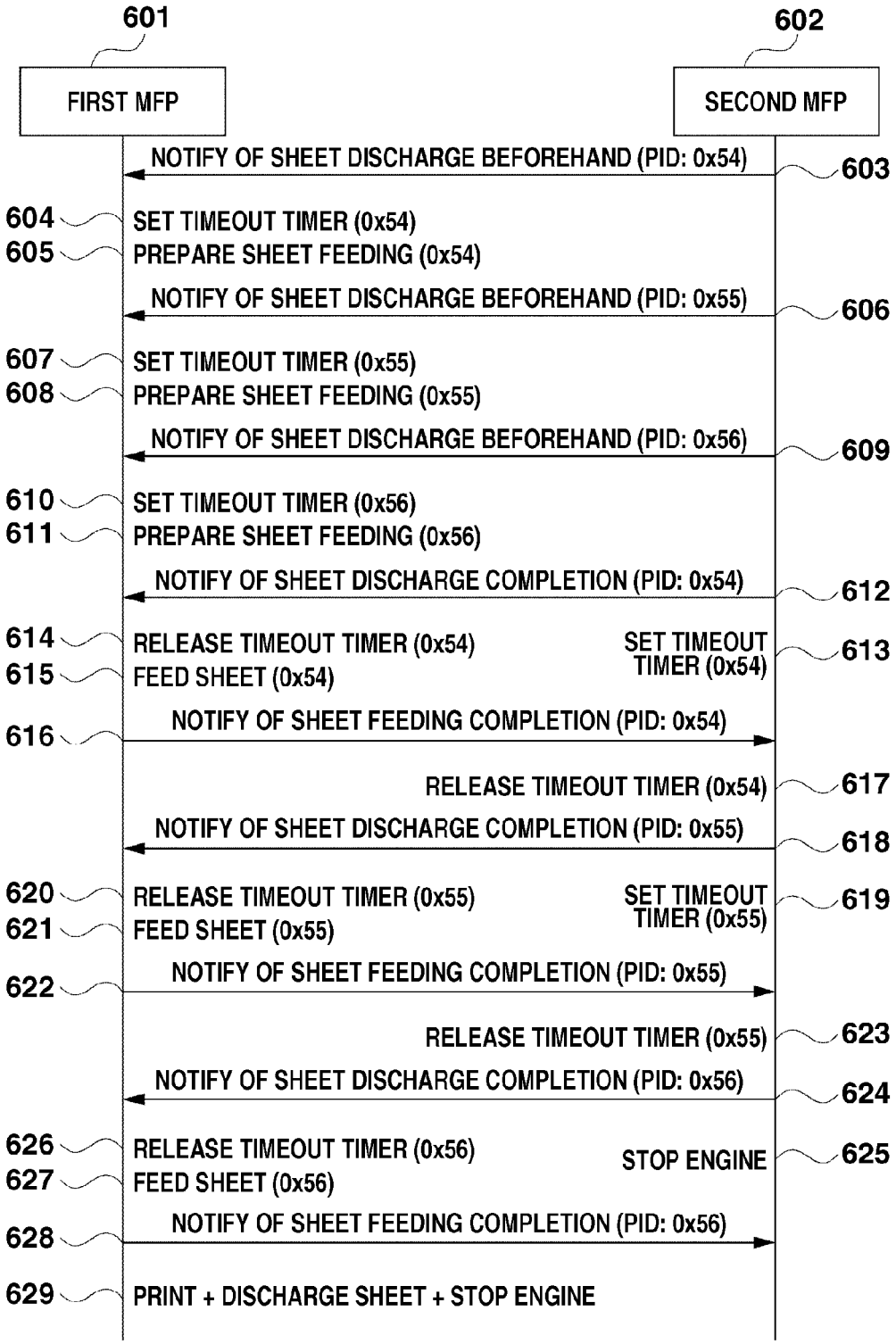
FIG. 6 illustrates a sequential diagram illustrating normal printing.

Next, referring to FIG. 6, a normal sequence where no stop occurs during printing of an original having three pages identified by O×54 to O×56 is described. Processing starts from the page identified by O×54. When sheet discharge preparation of the page identified by O×54 to the intermediate tray reaches a prescribed stage, in 603, a first MFP 601 transmits a sheet discharge advance notice of the page identified by O×54 to a second MFP 602. In 604, the second MFP 602 sets a timeout timer until a sheet discharge completion notification comes. In 605, to enable sheet feeding, the second MFP 602 makes preparation for rasterizing an image to be printed. Then, the two MFPs perform the following steps of 606 to 611: in 606, transmitting a sheet discharge advance notice of the page identified by O×55, in 607, setting a timeout timer, in 608, making sheet feeding preparation, in 609, transmitting a sheet discharge advance notice of the page identified by O×56, in 610, setting a timeout timer, and in 611, making sheet feeding preparation.

The first MFP 601 prints the page identified by O×54, and discharges it to the intermediate tray. Then, in 612, the first MFP 601 notifies of sheet discharge completion, and in 613, sets a timeout timer until the sheet is fed from the intermediate tray. Since the sheet discharge completion notification comes before time-out, in 614, the second MFP 602 releases the timeout timer, in 615, feeds the sheet from the intermediate tray, and in 616, notifies of a sheet feeding completion.

After the page identified by O×54 has been fed from the intermediate tray, in 617, the first MFP 601 releases the timeout timer.

The first MFP 601 prints the page identified by O×55, and discharges it to the intermediate tray. Then, in 618, the first MFP 601 notifies of sheet discharge completion, and in 619, sets a timeout timer until the sheet is fed from the intermediate tray. Since sheet discharge notification comes before time-out, in 620, the second MFP 602 releases the timeout timer, in 621, feeds the sheet from the intermediate tray, and in 622, notifies of sheet feeding completion.

After the page identified by O×55 has been fed from the intermediate tray, in 623, the first MFP 601 releases the timeout timer.

The first MFP 601 prints the page identified by O×56, and discharges it to the intermediate tray. Then, in 624, the first MFP 601 notifies of sheet discharge completion, and in 625, stops the engine since there is no next discharge-scheduled sheet. Since sheet discharge completion comes before time-out, in step 626, the second MFP 602 feeds the sheet from the intermediate tray, in 628, notifies of sheet feeding completion, and in 629, stops the engine after the end of printing and sheet discharging.

Figure 7:
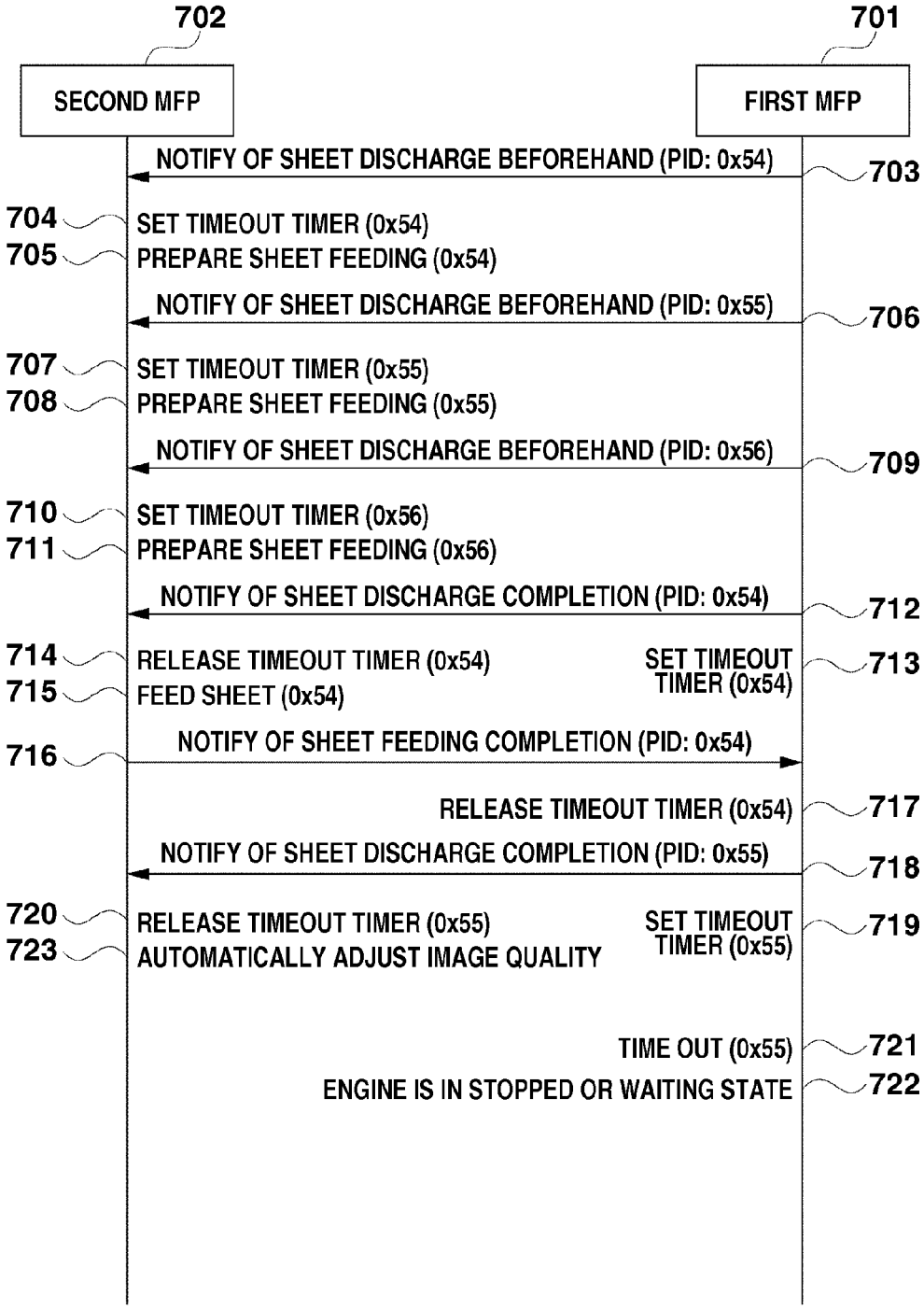
FIG. 7 is a sequential diagram illustrating stop control when detection control is not used.
Figure 8:
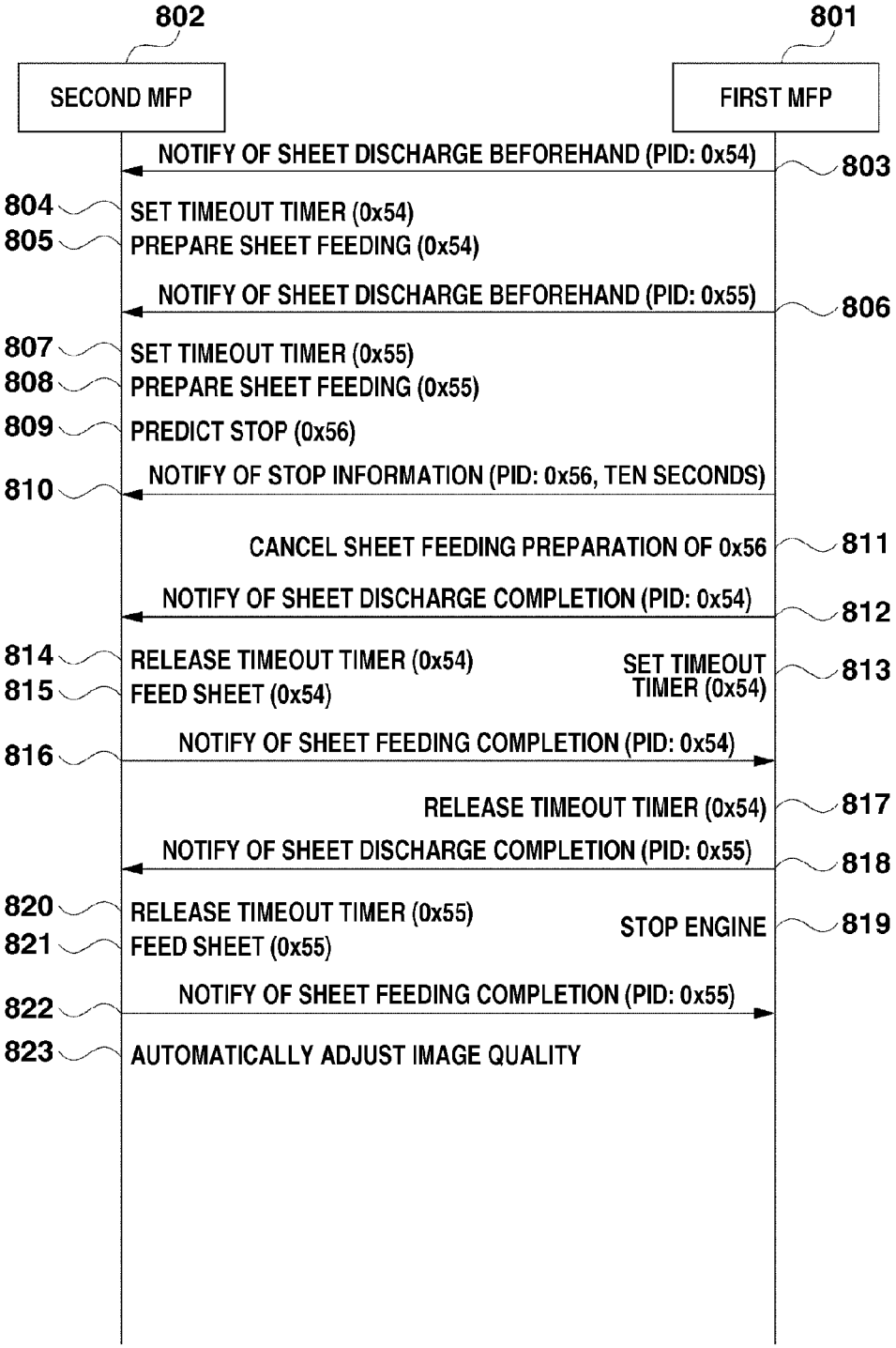
FIG. 8 is a sequential diagram illustrating stop control when detection control is used.

Next, referring to FIG. 7, a sequence of stop control when no detection control is used according to the present exemplary embodiment is described.

It is assumed that processing starts from the page identified by O×54, and a stop state inhibiting feeding of the page identified by O×55 is set in a second MFP 702.

When sheet discharge preparation of the page identified by O×54 to the intermediate tray reaches a prescribed stage, in 703, a first MFP 701 transmits a sheet discharge advance notice of the page identified by O×54 to the second MFP 702. In 704, the second MFP 702 sets a timeout timer until a sheet discharge completion notification comes. In 705, to enable sheet feeding, the second MFP 702 makes preparation for rasterizing an image to be printed. Then, the two MFPs perform the following steps of 706 to 711: in 706, transmitting a sheet discharge advance notice of the page identified by O×55, in 707, setting a timeout timer, in 708, making sheet feeding preparation, in 709, transmitting a sheet discharge advance notice of the page identified by O×56, in 710, setting a timeout timer, and in 711, making sheet feeding preparation.

The first MFP 701 prints the page identified by O×54, and discharges it to the intermediate tray. Then, in 712, the first MFP 701 notifies of sheet discharge completion, and in 713, sets a timeout timer until the sheet is fed from the intermediate tray. Since the sheet discharge completion notification comes before time-out, in 714, the second MFP 702 releases the timeout timer, in 715, feeds the sheet from the intermediate tray, and in 716, notifies of a sheet feeding completion.

After the page identified by O×54 has been fed from the intermediate tray, in 717, the first MFP 701 releases the timeout timer.

The first MFP 701 prints the page identified by O×55, and discharges it to the intermediate tray. Then, in 718, the first MFP 701 notifies of sheet discharge completion, and in 719, sets a timeout timer until the sheet is fed from the intermediate tray. Since sheet discharge notification comes before time-out, in 720, the second MFP 702 releases the timeout timer. However, when preparation for printing on the sheet of the page identified by O×55 is delayed, for example, automatic image quality adjustment 723 such as cleaning in the engine, agitation of consumables, discharging, fixing temperature adjustment, or density adjustment are delayed, a state where no sheet feeding is started continues.

In this case, since the page identified by O×55 has not been fed from the intermediate tray, in 721, time-out occurs by the time-out timer, and the first MFP 701 stands by in a state where the sheet of the page identified by O×56 is left in the machine, or stops the engine.

Thus, the fed sheet is retained in the first MFP 701, causing the abovementioned problem. When the engine is stopped, it takes time until printing is enabled after releasing of the stalled state as described above.

Next, a sequence of stop control when the detection control which solves the problem according to the present embodiment is used, is described.

It is assumed that processing starts from the page identified by O×54, and a stop state inhibiting feeding of the page identified by O×56 is set in a second MFP 802.

When sheet discharge preparation of the page identified by O×54 to the intermediate tray reaches a prescribed stage, in 803, a first MFP 801 transmits a sheet discharge advance notice of the page identified by O×54 to the second MFP 802. In 804, the second MFP 802 sets a timeout timer until a sheet discharge completion notification comes. In 805, to enable sheet feeding, the second MFP 802 makes preparation for rasterizing an image to be printed. Then, the two MFPs perform the following steps of 806 to 808: in 806, transmitting a sheet discharge advance notice of the page identified by O×55, in 807, setting a timeout timer, and in 808, making sheet feeding preparation.

When the second MFP 802 detects a delay of printing of the page identified by O×54 in 809, the second MFP 802 generates stop detection information, and in 810, notifies the first MFP 801 of the information. When feeding of the page identified by O×56 and printing preparation have been started, the first MFP 801 cancels the preparation. When the preparation is permitted to be started without cancellation, in 811, the first MFP 801 performs control to inhibit sheet feeding and printing.

The first MFP 801 prints the page identified by O×54, and discharges it to the intermediate tray. Then, in 812, the first MFP 801 notifies of sheet discharge completion, and in 813, sets a timeout timer until the sheet is fed from the intermediate tray. Since the sheet discharge completion notification comes before time-out, in 814, the second MFP 802 releases the timeout timer, in 815, feeds the sheet from the intermediate tray, and in 816, notifies of a sheet feeding completion.

After the page identified by X×54 has been fed from the intermediate tray, in 817, the first MFP 801 releases the timeout timer.

The first MFP 801 prints the page identified by O×55, and discharges it to the intermediate tray. Then, in 818, the first MFP 801 notifies of sheet discharge completion, and in 819, stops the engine since there is no next discharge-scheduled sheet. Since sheet discharge notification comes before time-out, in 820, the second MFP 802 releases the timeout timer, in 821, feeds the sheet from the intermediate tray, in 822, notifies of sheet feeding completion, and in 823, performs automatic image quality adjustment in the engine that has caused the stop.

Figure 9:
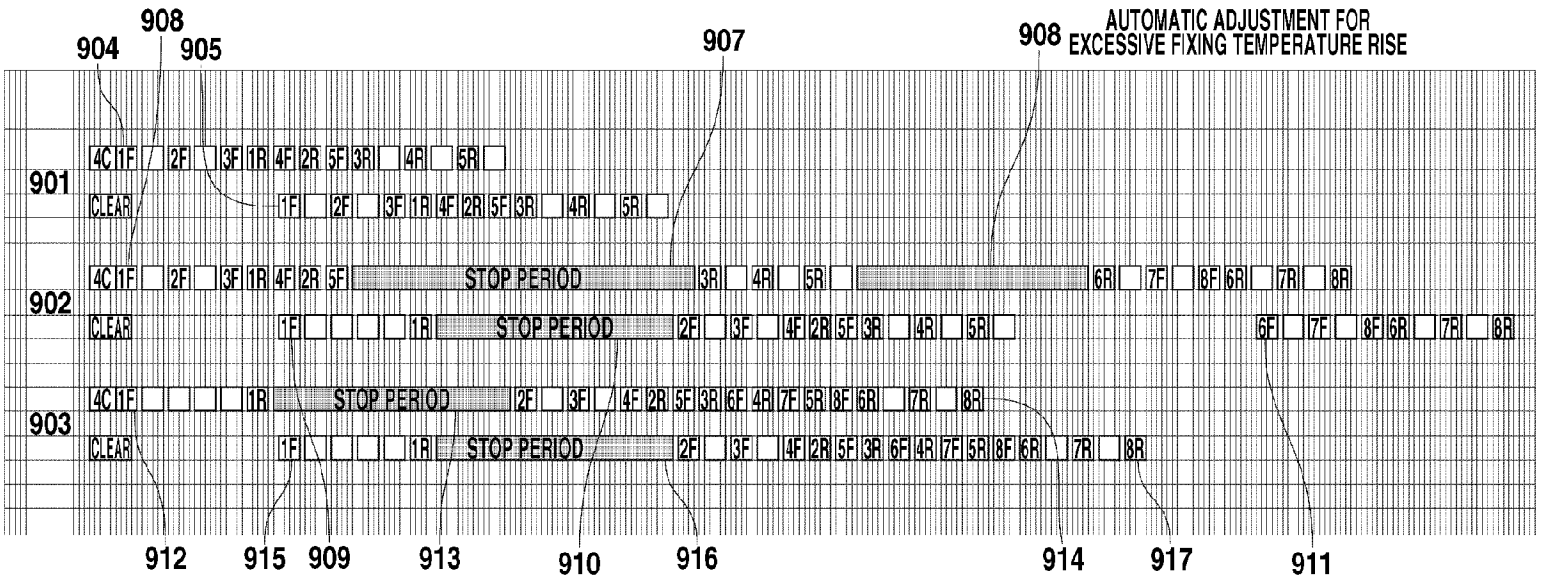
FIG. 9 is a timing chart during normal printing and detection control ON/OFF.

Next, referring to FIG. 9, timing when the normal printing and the stop detection control according to the present exemplary embodiment are turned ON/OFF is described. A chart 901 illustrates a case where no stop period occurs. A page 904 illustrates timing of printing on a front surface (F) of a first sheet by the first MFP. Thereafter, the first MFP performs printing on a front surface of a second sheet after an interval of one sheet, a front surface of a third sheet after an interval of one sheet, a rear surface (R) of the first sheet, and a front sheet of a fourth sheet in order. When the first MFP prints data on the rear surface of the first sheet to discharge the sheet to the intermediate tray, the second MFP prints clear toner subsequent to the front surface of the first sheet. A page 905 illustrates timing when the second MFP prints data on the front surface of the first sheet discharged from the first MFP.

A timing chart 902 illustrates a case where a stop period occurs, and the stop detection control according to the present exemplary embodiment is not used.

A page 908 illustrates timing when the first MFP prints data on a front surface of a first sheet. Thereafter, the first MFP performs printing on a surface of a second sheet after an interval of one sheet, a front surface of a third sheet after an interval of one sheet, a rear surface of the first sheet, and a front sheet of a fourth sheet. A page 909 illustrates timing when the second MFP prints data on the front surface of the first sheet discharged from the first MFP. When a stop period 910 is necessary at the time of printing on the front surface of the second sheet by the second MFP, the second sheet is not fed from the intermediate tray to the second MFP to be removed. Thus, in 907, the first MFP stops printing in a state inhibiting printing on a rear surface of the third sheet.

When the processing stands by without stopping the engine by turning off the developing and fixing systems in the first MFP, adjustment control 909 must be added to reduce a fixing temperature because of an excessive temperature rise of the fixing device if a state of no sheet feeding to the fixing device continues. In the engine stopped state, it takes time until printing is enabled again when the second MFP resumes sheet feeding. During this period, a sheet stays on the sheet path, causing a problem such as an undesirably formed sheet.

Even when resuming printing, since a sixth sheet is not discharged from the first MFP, the second MFP can feed a sheet at timing 911, resulting in a drop in total performance.

Timing chart 903 illustrates a case where a stop period occurs and the stop detection control according to the present exemplary embodiment is used. A page 912 illustrates timing when the first MFP performs printing on a front surface of a first sheet. In this case, it is assumed that the second MFP has notified the first MFP of a stop on a surface of a second sheet.

In 913, after discharging of the first sheet on a rear surface of which the data has been printed, in a state where the sheets in the machine have been completely discharged, the first MFP stops at timing when the second MFP can perform printing on the second sheet. At timing 915, the second MFP performs printing on the front surface of the first sheet discharged from the first MFP. In 916, the second MFP stops as scheduled after printing on both front and rear surfaces of the first sheet.

The first MFP resumes printing from the front surface of the second sheet at timing when the second sheet can be discharged to the intermediate tray when the second MFP is enabled to perform printing, and continuously prints data up to a rear surface 914 of an eighth sheet. The second MFP continuously prints data from the second sheet up to the rear surface 917 of the eighth sheet.

Next, referring to FIG. 10, the stop detection information according to the present exemplary embodiment is described.

The table illustrated in FIG. 10 includes attribute types 1001, 1003, and 1005, and values 1002, 1004, and 1006. As long as data are arrayed in prescribed order of values and data sizes, the data do not need any areas for indicating attributes. When an order or sizes are not defined, data can be represented by tags and values indicating attributes. An attribute 100 is an adjustment content indicating an adjustment function of "constant-speed automatic tone correction" 1002 in FIG. 10. The adjustment content is not always necessary.

The attribute 1003 indicates after how many pages from 1004 a stop state is set. In FIG. 10, the processing stops from a page identified by O×1d9a after twelve pages. In this case, the stop state is indicated by a number of pages or a number. However, any information such as absolute time or relative time from a stop can be used as long as it enables determination of timing. The attribute 1005 indicates a stop period of time. In FIG. 10, printing is resumed after 62030 milliseconds from 1006. In this case, relative time from the stop is used. However, any information such as absolute time or a number of pages can be used as long as it enables resumption timing.

Figure 11:
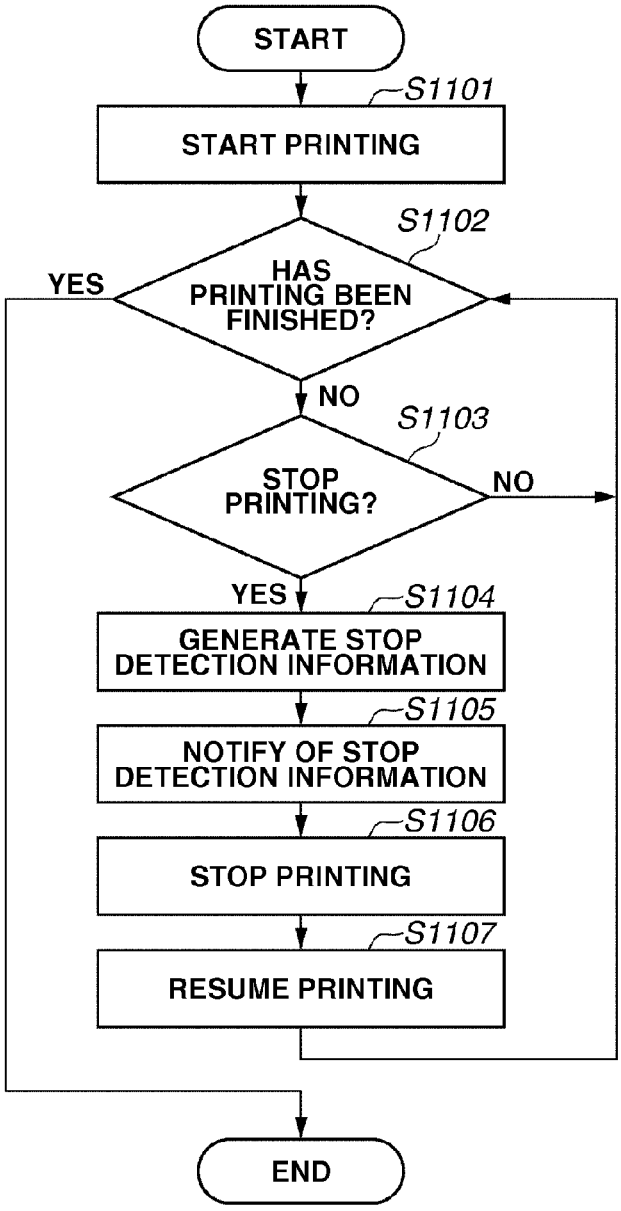
FIG. 11 is a flowchart illustrating control of a multifunction peripheral (MFP) of a stop detection information notification side.

Next, referring to FIG. 11, control of the MFP of the stop detection information notification side according to the present exemplary embodiment is described. Each processing in this flow is executed by the controller 102 of the first MFP 101 or the controller 122 of the second MFP 121.

It is assumed that the second MFP 121 has generated stop detection information. In step S1101, the second MFP 121 starts printing. In 1102, the second MFP 121 determines whether printing has been finished. When the printing has been finished (YES in step S1102), the second MFP 121 directly stops a printing job. When the printing has not been finished (No in step S1102), the processing proceeds to step S1103 to detect a printing stop. When no stop is scheduled (NO in step S1103), the processing returns to the printing end determination flow of step S1102. When a printing stop is scheduled (YES in step S1103), in step S1104, the second MFP 121 generates stop detection information. In step S1105, the second MFP 121 notifies the first MFP 101 of the stop detection information. In step S1106, the second MFP 121 stops printing on a stop-scheduled page. In step S1107, the second MFP 121 resumes printing at recovery timing, and the processing returns to the printing end determination of step S1102.

The first MFP 101 performs similar processing when generating stop detection information.

Figure 12:
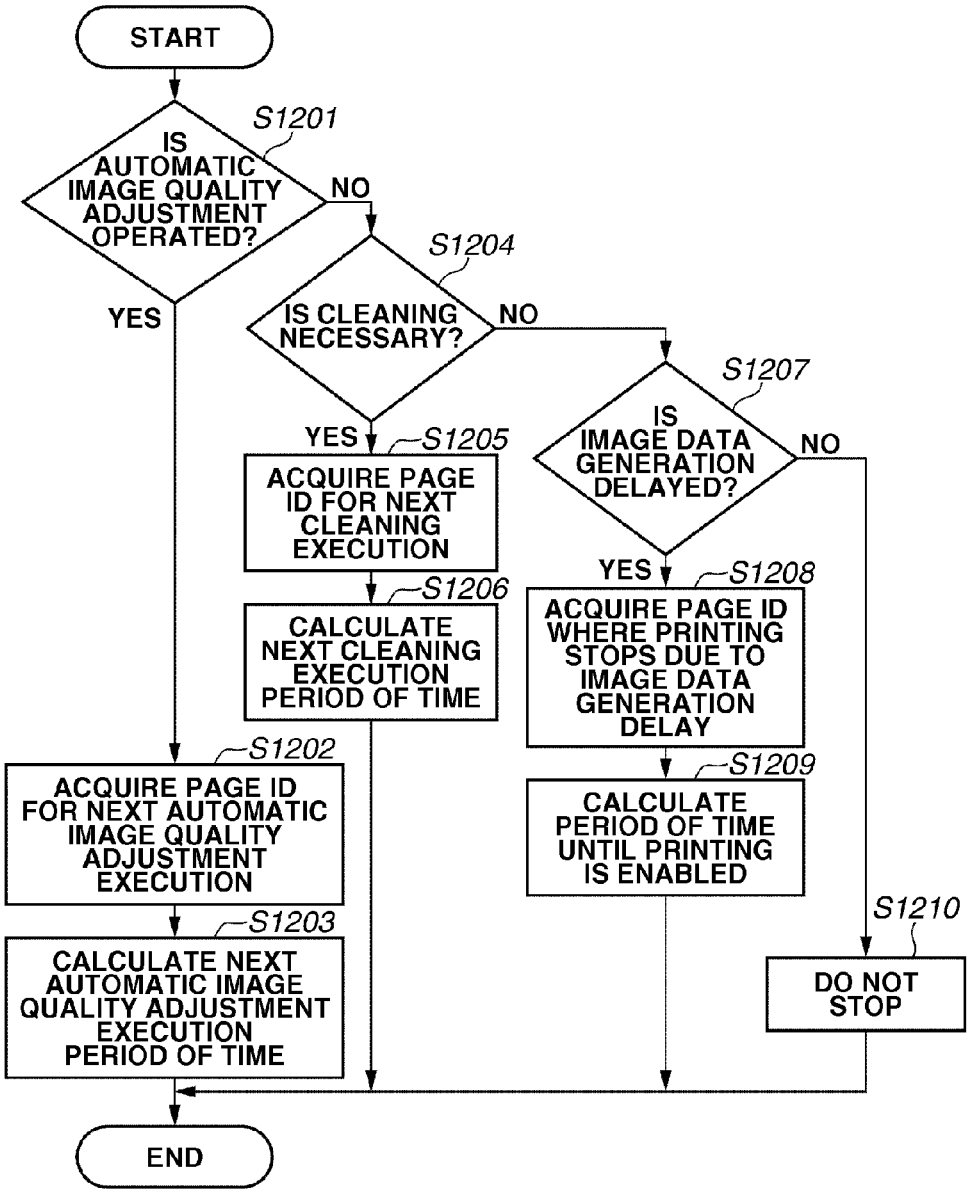
FIG. 12 is a flowchart illustrating printing stop determination control of the MFP of the stop detection information notification side.

Next, referring to FIG. 12, printing stop detection control on the MFP of the stop detection information notification side according to the present exemplary embodiment is described. Each processing in this flow is executed by the controller 102 of the first MFP 101 or the controller 122 of the second MFP 121. It is assumed that the second MFP 121 is the stop detection information notification side.

In step S1201, the second MFP 121 determines whether automatic image quality adjustment for adjusting a density is operated. When the automatic image quality adjustment is operated (YES in step S1021), in step S1202, the second MFP 121 calculates adjustment execution scheduled page ID. In step S1203, the second MFP 121 calculates an adjustment period of time and the stop detection is finished. When the automatic image quality adjustment is not operated (NO in step 1201), the processing proceeds to step S1204 to determine whether various cleaning control operations are performed. When a cleaning operation is necessary (YES in step S1204), the processing proceeds to step S1205 to calculate execution scheduled page ID. In step S1206, the second MFP 121 calculates a cleaning period of time to finish the stop detection. When a cleaning operation is not necessary (NO in step S1204), the processing proceeds to step S1207 to determine whether image data generation is delayed. When the image data generation is delayed, an operation stop (YES in step S1207) is required, the processing proceeds to step S1208 to calculate page ID as to which printing is stopped due to the image data generation delay. In step S1209, the MFP 121 calculates a period of time until printing is permitted to finish the stop detection. When image data generation is not delayed (NO in step S1207), the processing proceeds to step S1210, in which no stop is predicted. All possibilities of automatic image quality adjustment, cleaning, and an image data generation delay may be taken into consideration to calculate a total stop period of time of all kinds. Similar processing is performed when the first MFP 101 is on a stop detection information notification side.

Figure 13:
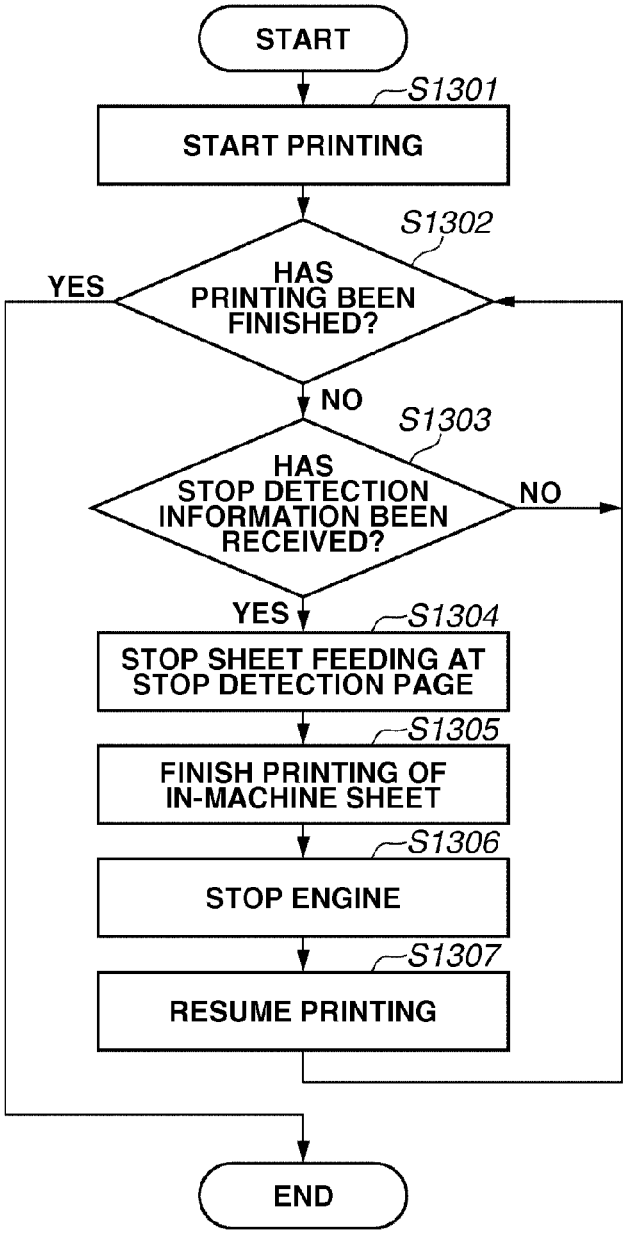
FIG. 13 is a flowchart illustrating control of a MFP of a stop detection information reception side.

Next, referring to FIG. 13, control of the MFP on the stop detection information reception side according to the present exemplary embodiment is described. Each processing in this flow is executed by the controller 102 of the first MFP 101 or the controller 122 of the second MFP 121.

It is assumed that the first MFP 101 receives stop detection information. In step S1301, the first MFP 101 starts printing. In step S1302, the first MFP 101 determines whether the printing has been finished. When the printing has been finished (YES in step S1302), the first MFP 101 directly finishes a printing job. When the printing has not been finished (NO in step S1302), in step S1303, the first MFP 101 determines whether printing detection prediction information has been received. When a stop is not scheduled (NO in step S1303), the processing returns to the printing end determination flow of step S1302. When there is a printing detection schedule (YES in step S1303), the processing proceeds to step S1304, and the first MFP 101 stops feeding of sheets to prevent feeding of pages after a page which is stopped from being printed. In other words, a sheet is fed to perform printing up to a page indicated by the stop detection information. To prevent retention of the fed sheet, printing is performed on the sheet, and the sheet is discharged from the first MFP 101. The discharged sheet is fed to the second MFP 121. In step S1305, the first MFP 101 finishes printing on all the sheets in the machine to discharge them. In step S1306, the first MFP 101 stops the engine. In step S1307, the first MFP 101 resumes printing at printing resumption scheduled timing, and the processing returns to the printing end determination of step S1102.

If total performance is higher when in step S1306, the first MFP 101 waits for operation resumption of the second MFP 121 that is a communication partner without stopping the engine, the first MFP 101 can stand by without stopping the engine. Similar processing is performed when the second MFP 121 receives stop detection information.

Figure 14:
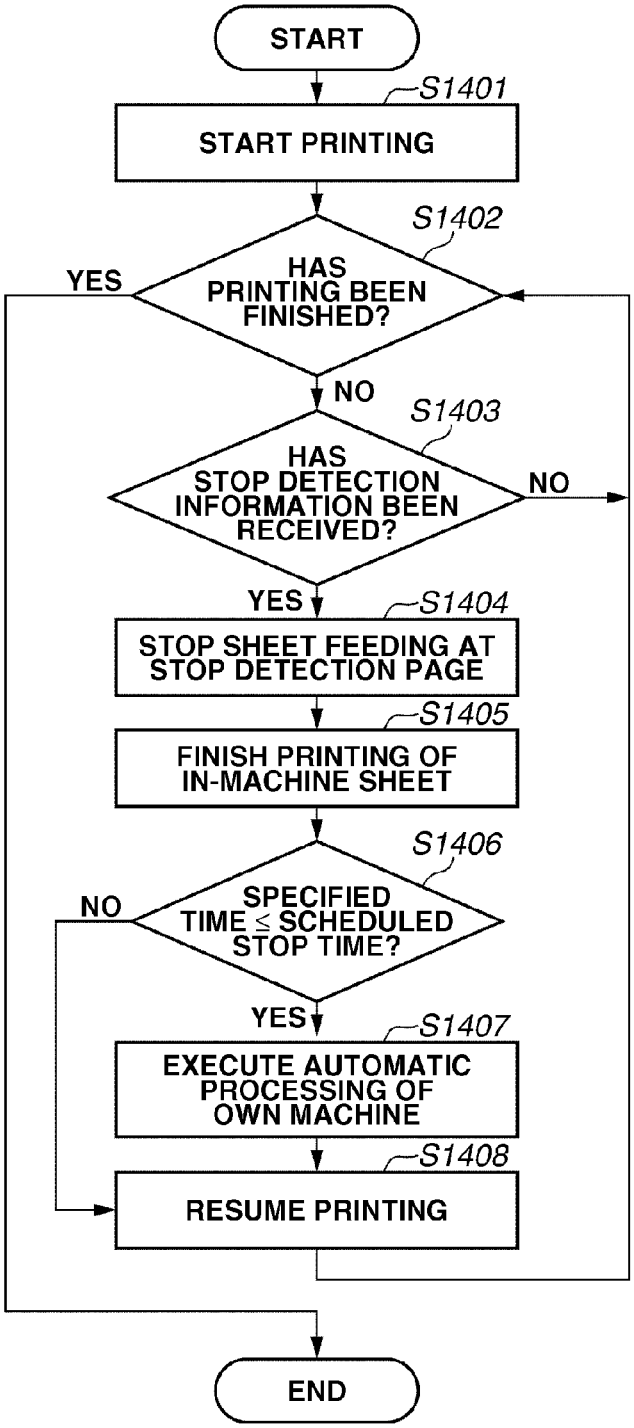
FIG. 14 is a flowchart illustrating own-machine automatic processing execution and determination control of the MFP of the stop detection information reception side.

Next, referring to FIG. 14, own-machine automatic processing execution determination control in the MFP on the stop detection information reception side according to the present exemplary embodiment is described. Each processing in this flow is executed by the controller 102 of the first MFP 101 or the controller 122 of the second MFP 121.

It is assumed that the first MFP 101 receives stop detection information. In step S1401, the first MFP 101 starts printing. In step S1402, the first MFP 101 determines whether the printing has been finished. When the printing has been finished (YES in step S1402), the first MFP 101 directly finishes a printing job. When the printing has not been finished (NO in step S1402), in step S1403, the first MFP 101 determines whether printing stop detection information has been received. When a stop is not scheduled (NO in step S1403), the processing returns to the printing end determination flow of step S1402. When there is a printing detection schedule (YES in step S1403), the processing proceeds to step S1404, and the first MFP 101 stops feeding of sheets to prevent feeding of pages after a page which is stopped from being printed. In other words, a sheet is fed to perform printing up to a page indicated by the stop detection information. To prevent retention of the fed sheet, printing is performed on the sheet, and the sheet is discharged from the first MFP 101. The discharged sheet is fed to the second MFP 121.

The processing proceeds to step 1406, and the first MFP 101 determines whether a stop period of time of the second MFP 121 that is a communication partner is enough for automatic processing such as image quality adjustment or cleaning in the own machine. When the stop period of time is not enough (NO in step S1406), the processing proceeds to step S1408, and the first MFP 101 waits for printing resumption to resume printing. When the stop period of time is enough (YES in step S1406), the processing proceeds to step S1407, and the first MFP 101 executes own-machine processing completed within the stop period of time. In step S1408, the first MFP 101 resumes printing at scheduled timing of a printing resumption. Similar processing is performed when the second MFP 121 receives stop detection information.

To make effective the stop detection information transmission/reception function, whether the communication partner corresponds to the stop detection must be determined. The function is made effective based on a configuration at start-up. Thus, a drop in performance caused by unexpected information reception and useless communication is prevented.

As described above, according to the present exemplary embodiment, when a plurality of printing apparatuses are interconnected to print data on one and the same sheet, a stop period of time of both recording operations each time the MFP on one of the front stage and the rear stage stalls can be limited to a minimum. As a result, overall performance of the printing system can be improved.

The present invention can be realized by executing the following processing. Specifically, software (program or non-transitory computer-readable storage medium) for realizing the function of the exemplary embodiment is supplied to a system or an apparatus via a network or various storage media, and a computer (or a CPU or a microprocessor unit (MPU)) of the system or the apparatus reads the program to execute it.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-297379 filed Dec. 28, 2009, which is hereby incorporated by reference herein in its entirety.

What is claimed is:

1. A printing system comprising:

a first printing apparatus configured to perform printing by using a first color material; and a second printing apparatus configured to perform printing by using a second color material, wherein a sheet discharge unit of the first printing apparatus and a sheet feeding unit of the second printing apparatus are interconnected, wherein the first printing apparatus includes:

a reception unit configured to receive, from the second printing apparatus, stop detection information regarding timing of a printing stop in the second printing apparatus; and a control unit configured to feed sheets for performing printing up to a page indicated by the stop detection information received by the reception unit, perform printing on the sheets by using the first color material to prevent retention of the fed sheets, and cancel feeding preparation of the sheets for printing the page indicated by the stop information and succeeding pages, and wherein the second printing apparatus includes:

a stop detection information generation unit configured to detect timing of a printing stop in the second printing apparatus, and generate stop detection information regarding the stop timing;

a transmission unit configured to transmit the stop detection information generated by the stop detection information generation unit to the first printing apparatus; and a printing unit configured to perform printing, by using the second color material, on the sheets on which the printing has been performed by the control unit, wherein a total stop period of time is calculated when the stop detection information is generated by the stop detection information generation unit, the total stop period of time indicative of at least resumption of processing performed by the first printing apparatus.

2. The printing system according to claim 1, wherein the stop detection information contains ID to identify a page of an image printed by the first printing apparatus and the second printing apparatus.

3. The printing system according to claim 1, wherein when the second printing apparatus is in a printing-stopped state, the first printing apparatus executes own-machine automatic image quality adjustment or cleaning, or stops an engine of the own-machine.

4. The printing system according to claim 1, wherein the second printing apparatus includes a unit configured to determine whether the connected first printing apparatus includes the control unit, and switch between transmission of the stop detection information when a result of the determination shows that the control unit is included and non-transmission of the stop detection information when the result of the determination shows that the control unit is not included.

5. The printing system according to claim 1, wherein the stop detection information generation unit detects that the printing in the second printing apparatus stops due to one of automatic image quality adjustment, cleaning, and an image data generation delay in the second printing apparatus, and generates information regarding timing of the printing stop in the second printing apparatus.

6. A printing apparatus connected to another printing apparatus to feed sheets to another printing apparatus, the printing apparatus comprising:

a reception unit configured to receive, from another printing apparatus, stop detection information regarding timing of a printing stop in another printing apparatus; and a control unit configured to feed sheets for performing printing up to a page indicated by the stop detection information received by the reception unit, perform printing on the sheets to prevent retention of the fed sheets, and cancel feeding preparation of the sheets for printing the page indicated by the stop information and succeeding pages, wherein a total stop period of time is calculated when the stop detection information is received by the reception unit, the total stop period of time indicative of at least resumption of processing performed by the printing apparatus.

7. The printing apparatus according to claim 6, wherein automatic image quality adjustment or cleaning is performed when the total stop period of time indicated by the stop detection information is longer than a period of time for the automatic image quality adjustment or the cleaning.

8. A printing apparatus connected to another printing apparatus, to which sheets are conveyed from another printing apparatus, the printing apparatus comprising:

a stop detection unit configured to determine whether to execute processing regarding a printing stop, including whether automatic image quality adjustment is performed, whether cleaning is performed, or whether image data generation is delayed;

a stop detection information generation unit configured to detect, when the stop detection unit determines that the processing regarding the printing stop is executed, timing of the printing stop, and generate stop detection information regarding the stop timing; and a transmission unit configured to transmit the stop detection information generated by the stop detection information generation unit to another printing apparatus, wherein a total stop period of time is calculated when the stop detection information is generated by the stop detection information generation unit, the total stop period of time indicative of at least resumption of processing performed by the printing apparatus.

9. A method for controlling a printing apparatus connected to another printing apparatus to feed sheets to the another printing apparatus, the method comprising:

receiving, from the another printing apparatus, stop detection information regarding timing of a printing stop in another printing apparatus; and calculating, when the stop detection information is received, a total stop period of time indicative of at least resumption of processing performed by the printing apparatus;

feeding sheets for performing printing up to a page indicated by the received stop detection information;

performing printing on the sheets to prevent retention of the fed sheets; and canceling feeding preparation of the sheets for printing the page indicated by the stop information and succeeding pages.

10. The method according to claim 9, wherein automatic image quality adjustment or cleaning is performed when the total stop period of time indicated by the stop detection information is longer than a period of time for the automatic image quality adjustment or the cleaning.

11. A method for controlling a printing apparatus connected to another printing apparatus, to which sheets are conveyed from the another printing apparatus, the method comprising:

determining whether to execute processing regarding a printing stop, that is including whether automatic image quality adjustment is performed, whether cleaning is performed, or whether image data generation is delayed;

detecting, when the processing regarding the printing stop is determined to be executed, timing of the printing stop, and generating stop detection information regarding the stop timing;

calculating, when the stop detection information is generated, a total stop period of time indicative of at least resumption of processing performed by the printing apparatus; and transmitting the generated stop detection information to another printing apparatus.

12. A non-transitory computer-readable storage medium for controlling a printing apparatus connected to another printing apparatus to feed sheets to the another printing apparatus, the method comprising:

receiving, from the another printing apparatus, stop detection information regarding timing of a printing stop in another printing apparatus;

calculating, when the stop detection information is received, a total stop period of time indicative of at least resumption of processing performed by the printing apparatus;

feeding sheets for performing printing up to a page indicated by the received stop detection information;

performing printing on the sheets to prevent retention of the fed sheets; and canceling feeding preparation of the sheets for printing the page indicated by the stop detection information and succeeding pages.

13. A non-transitory computer-readable storage medium for controlling a printing apparatus connected to another printing apparatus, to which sheets are conveyed from the another printing apparatus, the method comprising:

determining whether to execute processing regarding a printing stop, including whether automatic image quality adjustment is performed, whether cleaning is performed, or whether image data generation is delayed;

detecting, when the processing regarding the printing stop is determined to be executed, timing of the printing stop, and generating stop detection information regarding the stop timing;

calculating, when the stop detection information is generated, the total stop period of time indicative of at least resumption of processing performed by the printing apparatus; and transmitting the generated stop detection information to another printing apparatus.

* * * * *